US006424319B2

(12) United States Patent
Ebling et al.

(10) Patent No.: US 6,424,319 B2
(45) Date of Patent: Jul. 23, 2002

(54) MULTI-BEAM ANTENNA

(75) Inventors: James Paul Ebling; Gabriel Rebeiz, both of Ann Arbor, MI (US)

(73) Assignee: Automotive Systems Laboratory, Inc., Farmington Hills, MI (US)

( * ) Notice: Subject to any disclaimer, the term of this patent is extended or adjusted under 35 U.S.C. 154(b) by 0 days.

(21) Appl. No.: 09/716,736

(22) Filed: Nov. 20, 2000

Related U.S. Application Data

(60) Provisional application No. 60/166,231, filed on Nov. 18, 1999.

(51) Int. Cl.[7] ..... H01Q 15/08

(52) U.S. Cl. ..... 343/911 L; 343/754; 343/753

(58) Field of Search ..... 343/753, 754, 343/755, 853, 911 R, 911 L

(56) References Cited

U.S. PATENT DOCUMENTS

| | | | | | |
|---|---|---|---|---|---|
| 3,761,936 | A | * | 9/1973 | Archer et al. | 343/754 |
| 4,222,054 | A | * | 9/1980 | Capps | 343/754 |
| 4,268,831 | A | * | 5/1981 | Valentino et al. | 343/754 |
| 4,288,795 | A | * | 9/1981 | Shelton | 343/754 |
| 4,641,144 | A | * | 2/1987 | Prickett | 343/754 |
| 4,845,507 | A | * | 7/1989 | Archer et al. | 343/754 |
| 4,983,237 | A | * | 1/1991 | Alfing | 156/83 |
| 5,099,253 | A | * | 3/1992 | Archer | 343/754 |
| 5,274,389 | A | * | 12/1993 | Archer et al. | 343/754 |
| 5,347,287 | A | * | 9/1994 | Speciale | 342/375 |
| 5,712,643 | A | * | 1/1998 | Skladany | 343/700 MS |
| 5,821,908 | A | * | 10/1998 | Sreenivas | 343/911 R |
| 5,874,915 | A | * | 2/1999 | Lee et al. | 342/375 |
| 5,892,487 | A | * | 4/1999 | Fujimoto et al. | 343/840 |
| 5,894,288 | A | * | 4/1999 | Lee et al. | 343/770 |
| 5,913,549 | A | * | 6/1999 | Skladany | 29/600 |
| 5,926,134 | A | | 7/1999 | Pons et al. | 342/368 |
| 6,031,501 | A | * | 2/2000 | Rausch et al. | 343/754 |
| 6,046,703 | A | | 4/2000 | Wang et al. | 343/795 |
| 6,061,035 | A | | 5/2000 | Kinasewitz et al. | 343/853 |

OTHER PUBLICATIONS

G. Bekefi, and G. W. Farnell, "A homogenous dielectric sphere as a mi–crowave lens," Canadian Journal of Physics, vol. 34, pp. 790–803, 1956.

G. Toraldo di Francia, "Spherical lenses for infrared and microwaves," Journal of Applied Physics, vol. 32, pp. 2051, 1961.

T. L. Ap Rhys, "The design of radially symmetric lenses," IEEE Trans. on Antennas and Propagation, AP–18, pp. 497–506, Jul. 1970.

L. C. Gunderson, "An electromagnetic analysis of a cylindrical homoge–nous lens," IEEE Trans. on Antennas and Propagationn, AP–20, pp. 476–479, Jul. 1972.

S. Lee, M. S. Shesadri, V. Jamnejad, and R. Mittra, "Refraction at a curved dielectric interface: geometrical optics solution," IEEE Trans. on Microwave Theory and Techniques, MTT–30, No. 1, pp. 12–19, Jan. 1982.

(List continued on next page.)

*Primary Examiner*—Tan Ho
(74) *Attorney, Agent, or Firm*—Dinnin & Dunn P.C.

(57) ABSTRACT

At least one electromagnetic lens having a first contour is disposed proximate to a dielectric substrate having a first edge having a second contour. A plurality of antenna feed elements, for example, end-fire antennas, are disposed on the dielectric substrate along the second contour. A signal applied to a corporate feed port is switched to the antenna feed elements by a switching network, wherein each antenna feed element launches an electromagnetic wave that is diffracted by the at least one electromagnetic lens so as to form an associated beam of electromagnetic energy. Different antenna feed elements generate different beams of electromagnetic energy in different directions. A pair of electromagnetic lenses with associated antenna feed elements at different edge locations on the dielectric substrate provide for bi-static operation. A reflector may be used to redirect the beams of electromagnetic energy.

19 Claims, 5 Drawing Sheets

OTHER PUBLICATIONS

M. N. Afsar, "Dielectric measurements of common polymers at millimeter wavelength range," in IEEE MTT–S Digest, pp. 439–442, 1985.

J. Ahkenazy, E. Levine, and D. Treves, "Radiometric measurement of antenna efficiency," in Electron, Lett., vol. 21, No. 3, pp. 111–112, Jan. 1985.

K. S. Yngvesson, T. L. Korzeniowski, Y. S. Kim, E. L. Kollberg, and J. F. Johansson, "The tapered slot antenna—a new integrated element for mm–wave applications," IEEE Trans. on Microwave Theory and Techniques, MTT–37, No. 2, pp. 365–374, Feb. 1989.

J. Sanford, "A luneberg–lens update," IEEE Antennas and Propagation Magazine, vol. 37, No, 1, pp. 76–79, 1995.

S. Sugawara, Y. Maita, K. Adachi, K. Mori and K. Mizuno, "A mm–wave tapered slot antenna with improved radiation pattern," in 1997 IEEE MTT–S Int. Micorwave Symp. Dig., Anaheim, CA, Jun. 1997, pp. 959–962.

K. K. Chan, S. K. Rao, G. A. Morin, and M. Q. Tang, "Triangular ray–tube analysis of dielectric lens antennas," IEEE Trans. on Antennas and Propagation, vol. 45, No. 8, pp. 1277–1285, Aug. 1997.

F. Demmerle, S. Kern, and W. Wiesbeck, "A bi–conical multibeam antenna for space division multiple access," in Antennas and Propagation Society International Symposium, Montreal, Aug. 1997, pp. 1082–1085.

H. Mosallaei, and Yahya Rahmat–Samii "Nonuniform luneburg and two–shell lens antennas: radiation characteristics and design optimization," IEEE Trans. on Antennas and Propagation, vol. 49, No. 1, pp. 60–68, Jan. 2001.

I. Gresham, N. Jain, T. Budka, A. Alexanian, N. Kinayman, B. Ziegner, S. Brown, and P. Staecker, "A compact manufactureable 76–77 Ghz radar module for commerical ACC applications," IEEE Trans. on Microwave Theory and Techniques, vol. 49, No. 1, pp. 44–58, Jan. 2001.

* cited by examiner

MULTI-BEAM ANTENNA

CROSS-REFERENCE TO RELATED APPLICATIONS

The instant application claims the benefit of prior U.S. Provisional Application Ser. No. 60/166,231 filed on Nov. 18, 1999, which is incorporated herein by reference.

DETAILED DESCRIPTION OF EMBODIMENT (S)

Figure 1:
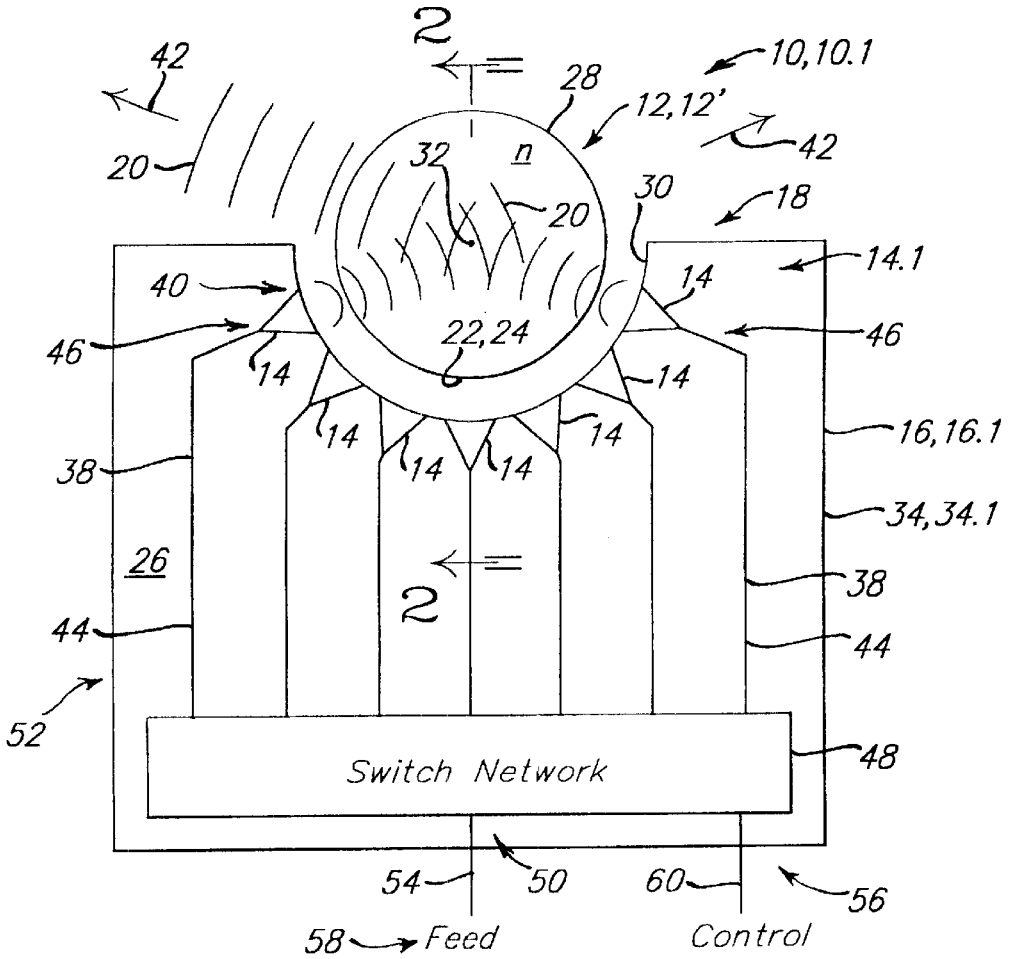
FIG. 1 illustrates a top view of a first embodiment of a multi-beam antenna comprising an electromagnetic lens.
Figure 2:
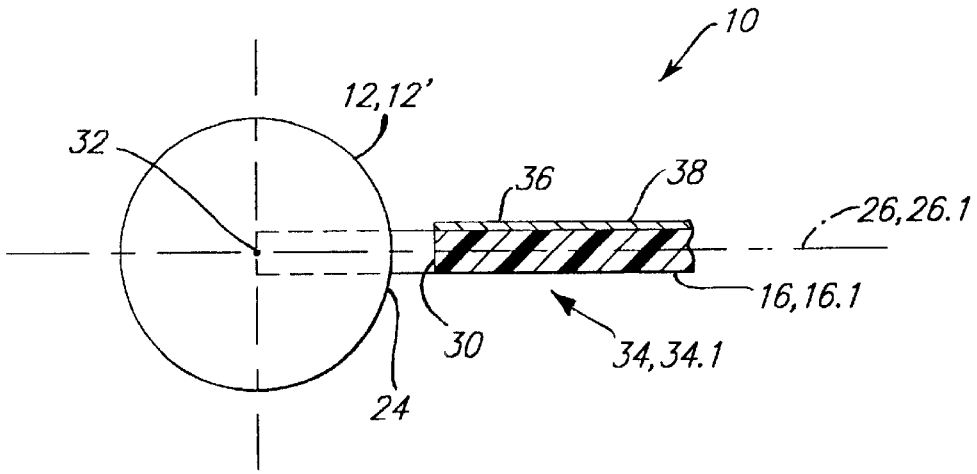
FIG. 2 illustrates a side cross-section of the embodiment of FIG. 1.

Referring to FIGS. 1 and 2, a multi-beam antenna 10, 10.1 comprises at least one electromagnetic lens 12 and a plurality of antenna feed elements 14 on a dielectric substrate 16 proximate to a first edge 18 thereof, wherein the plurality of antenna feed elements 14 are adapted to radiate a respective plurality of beams of electromagnetic energy 20 through the at least one electromagnetic lens 12.

Figure 3:
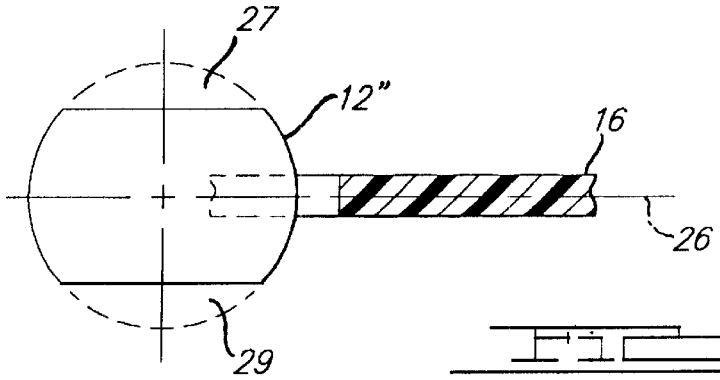
FIG. 3 illustrates a side cross-section of the embodiment of FIG. 1 incorporating a truncated electromagnetic lens.

The at least one electromagnetic lens 12 has a first side 22 having a first contour 24 at an intersection of the first side 22 with a reference surface 26, for example, a plane 26.1. The at least one electromagnetic lens 12 acts to diffract the electromagnetic wave from the respective antenna feed elements 14, wherein different antenna feed elements 14 at different locations and in different directions relative to the at least one electromagnetic lens 12 generate different associated beams of electromagnetic energy 20. The at least one electromagnetic lens 12 has a refractive index n different from free space, for example, a refractive index n greater than one (1). For example, the at least one electromagnetic lens 12 may be constructed of a material such as Rexolite™, Teflon™, polyethylene, or polystyrene; or a plurality of different materials having different refractive indices, for example as in a Luneburg lens. In accordance with known principles of diffraction, the shape and size of the at least one electromagnetic lens 12, the refractive index n thereof, and the relative position of the antenna feed elements 14 to the electromagnetic lens 12 are adapted in accordance with the radiation patterns of the antenna feed elements 14 to provide a desired pattern of radiation of the respective beams of electromagnetic energy 20 exiting the second side 28 of the at least one electromagnetic lens 12. Whereas the at least one electromagnetic lens 12 is illustrated as a spherical lens 12' in FIGS. 1 and 2, the at least one electromagnetic lens 12 is not limited to any one particular design, and may, for example, comprise either a spherical lens, a Luneburg lens, a spherical shell lens, a hemispherical lens, an at least partially spherical lens, an at least partially spherical shell lens, a cylindrical lens, or a rotational lens. Moreover, one or more portions of the electromagnetic lens 12 may be truncated for improved packaging, without significantly impacting the performance of the associated multi-beam antenna 10, 10.1. For example, FIG. 3 illustrates an at least partially spherical electromagnetic lens 12" with opposing first 27 and second 29 portions removed therefrom.

Figure 4:
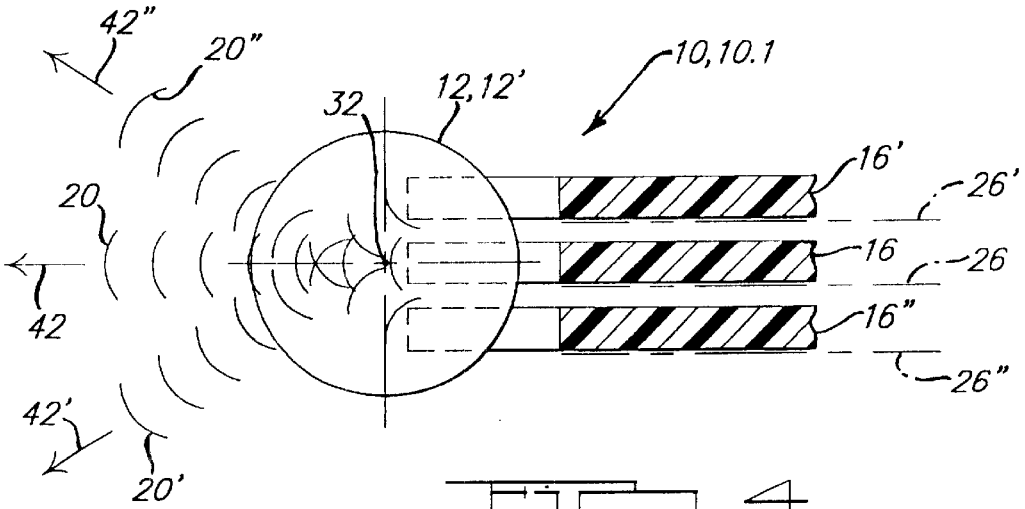
FIG. 4 illustrates a side cross-section of an embodiment illustrating various locations of a dielectric substrate, relative to an electromagnetic lens.

The first edge 18 of the dielectric substrate 16 comprises a second contour 30 that is proximate to the first contour 24. The first edge 18 of the dielectric substrate 16 is located on the reference surface 26, and is positioned proximate to the first side 22 of one of the at least one electromagnetic lens 12. The dielectric substrate 16 is located relative to the electromagnetic lens 12 so as to provide for the diffraction by the at least one electromagnetic lens 12 necessary to form the beams of electromagnetic energy 20. For the example of a multi-beam antenna 10 comprising a planar dielectric substrate 16 located on reference surface 26 comprising a plane 26.1, in combination with an electromagnetic lens 12 having a center 32, for example, a spherical lens 12'; the plane 26.1 may be located substantially close to the center 32 of the electromagnetic lens 12 so as to provide for diffraction by at least a portion of the electromagnetic lens 12. Referring to FIG. 4, the dielectric substrate 16 may also be displaced relative to the center 32 of the electromagnetic lens 12, for example on one or the other side of the center 32 as illustrated by dielectric substrates 16' and 16", which are located on respective reference surfaces 26' and 26".

The dielectric substrate 16 is, for example, a material with low loss at an operating frequency, for example, Duroid™, a Teflon™ containing material, a ceramic material, or a composite material such as an epoxy/fiberglass composite. Moreover, in one embodiment, the dielectric substrate 16 comprises a dielectric 16.1 of a circuit board 34, for example, a printed circuit board 34.1 comprising at least one conductive layer 36 adhered to dielectric substrate 16, from which the antenna feed elements 14 and other associated circuit traces 38 are formed, for example, by subtractive technology, for example, chemical or ion etching, or stamping; or additive techniques, for example, deposition, bonding or lamination.

The plurality of antenna feed elements 14 are located on the dielectric substrate 16 along the second contour 30 of the first edge 18, wherein each antenna feed element 14 comprises a least one conductor 40 operatively connected to the dielectric substrate 16. For example, at least one of the antenna feed elements 14 comprises an end-fire antenna element 14.1 adapted to launch or receive electromagnetic waves in a direction 42 substantially towards or from the first side 22 of the at least one electromagnetic lens 12, wherein different end-fire antenna elements 14.1 are located at different locations along the second contour 30 so as to launch or receive respective electromagnetic waves in different directions 42. An end-fire antenna element 14.1 may, for example, comprise either a Yagi-Uda antenna, a coplanar horn antenna (also known as a tapered slot antenna), a Vivaldi antenna, a tapered dielectric rod, a slot antenna, a dipole antenna, or a helical antenna, each of which is capable of being formed on the dielectric substrate 16, for example, from a printed circuit board 34.1, for example, by subtractive technology, for example, chemical or ion etching, or stamping; or additive techniques, for example, deposition, bonding or lamination. Moreover, the antenna feed elements 14 may be used for transmitting, receiving or both.

Referring to FIG. 4, the direction 42 of the one or more beams of electromagnetic energy 20 through the electromagnetic lens 12, 12' is responsive to the relative location of the dielectric substrate 16, 16' or 16" and the associated reference surface 26, 26' or 26" relative to the center 32 of the electromagnetic lens 12. For example, with the dielectric substrate 16 substantially aligned with the center 32, the directions 42 of the one or more beams of electromagnetic energy 20 are nominally aligned with the reference surface 26. Alternately, with the dielectric substrate 16' above the center 32 of the electromagnetic lens 12, 12', the resulting one or more beams of electromagnetic energy 20' propagate in directions 42' below the center 32. Similarly, with the dielectric substrate 16" below the center 32 of the electromagnetic lens 12, 12', the resulting one or more beams of electromagnetic energy 20" propagate in directions 42" above the center 32.

The multi-beam antenna 10 may further comprise at least one transmission line 44 on the dielectric substrate 16 operatively connected to a feed port 46 of one of the plurality of antenna feed elements 14 for feeding a signal to the associated antenna feed element 14. For example, the at least one transmission line 44 may comprise either a stripline, a microstrip line, an inverted microstrip line, a slotline, an image line, an insulated image line, a tapped image line, a coplanar stripline, or a coplanar waveguide line formed on the dielectric substrate 16, for example, from a printed circuit board 34.1, for example, by subtractive technology, for example, chemical or ion etching, or stamping; or additive techniques, for example, deposition, bonding or lamination.

The multi-beam antenna 10 may further comprise a switching network 48 having at least one input 50 and a plurality of outputs 52, wherein the at least one input 50 is operatively connected—for example, via at least one above described transmission line 44—to a corporate antenna feed port 54, and each output 52 of the plurality of outputs 52 is connected—for example, via at least one above described transmission line 44—to a respective feed port 46 of a different antenna feed element 14 of the plurality of antenna feed elements 14. The switching network 48 further comprises at least one control port 56 for controlling which outputs 52 are connected to the at least one input 50 at a given time. The switching network 48 may, for example, comprise either a plurality of micro-mechanical switches, PIN diode switches, transistor switches, or a combination thereof, and may, for example, be operatively connected to the dielectric substrate 16, for example, by surface mount to an associated conductive layer 36 of a printed circuit board 34.1.

In operation, a feed signal 58 applied to the corporate antenna feed port 54 is either blocked—for example, by an open circuit, by reflection or by absorption,—or switched to the associated feed port 46 of one or more antenna feed elements 14, via one or more associated transmission lines 44, by the switching network 48, responsive to a control signal 60 applied to the control port 56. It should be understood that the feed signal 58 may either comprise a single signal common to each antenna feed element 14, or a is plurality of signals associated with different antenna feed elements 14. Each antenna feed element 14 to which the feed signal 58 is applied launches an associated electromagnetic wave into the first side 22 of the associated electromagnetic lens 12, which is diffracted thereby to form an associated beam of electromagnetic energy 20. The associated beams of electromagnetic energy 20 launched by different antenna feed elements 14 propagate in different associated directions 42. The various beams of electromagnetic energy 20 may be generated individually at different times so as to provided for a scanned beam of electromagnetic energy 20. Alternately, two or more beams of electromagnetic energy 20 may be generated simultaneously. Moreover, different antenna feed elements 14 may be driven by different frequencies that, for example, are either directly switched to the respective antenna feed elements 14, or switched via an associated switching network 48 having a plurality of inputs 50, at least some of which are each connected to different feed signals 58.

Figure 5:
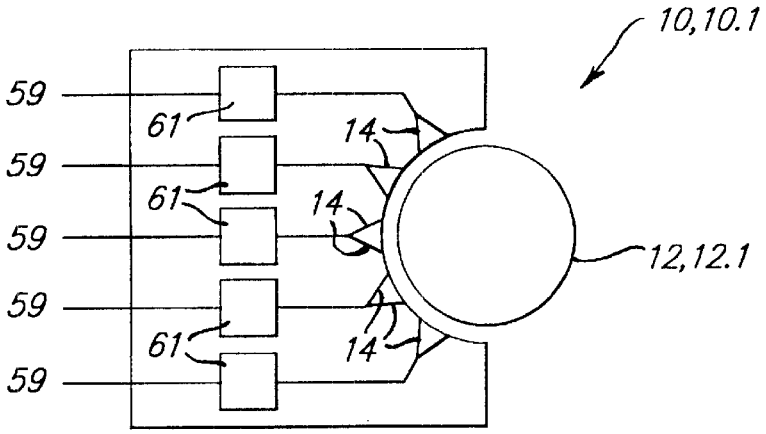
FIG. 5 illustrates an embodiment wherein each antenna feed element is operatively coupled to a separate signal.

Referring to FIG. 5, the multi-beam antenna 10, 10.1 may be adapted so that the respective signals are associated with the respective antenna feed elements 14 in a one-to-one relationship, thereby precluding the need for an associated switching network 48. For example, each antenna feed element 14 can be operatively connected to an associated signal 59 through an associated processing element 61. As one example, with the multi-beam antenna 10, 10.1 configured as an imaging array, the respective antenna feed elements 14 are used to receive electromagnetic energy, and the respective processing elements 61 comprise detectors. As another example, with the multi-beam antenna 10, 10.1 configured as a communication antenna, the respective antenna feed elements 14 are used to both transmit and receive electromagnetic energy, and the respective processing elements 61 comprise transmit/receive modules or transceivers.

Figure 6:
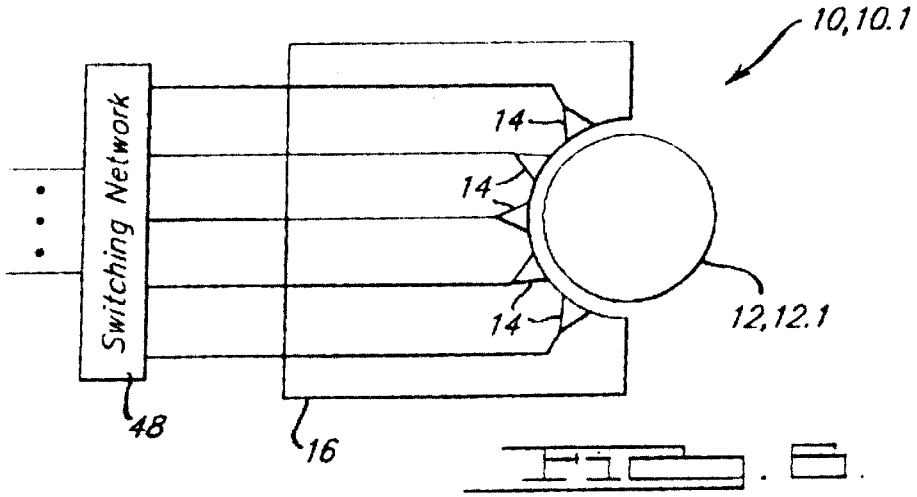
FIG. 6 illustrates an embodiment wherein the switching network is separately located from the dielectric substrate.

Referring to FIG. 6, the switching network 48, if used, need not be collocated on a common dielectric substrate 16, but can be separately located, as, for example, may be useful for low frequency applications, for example, 1–20 GHz.

Figure 7:
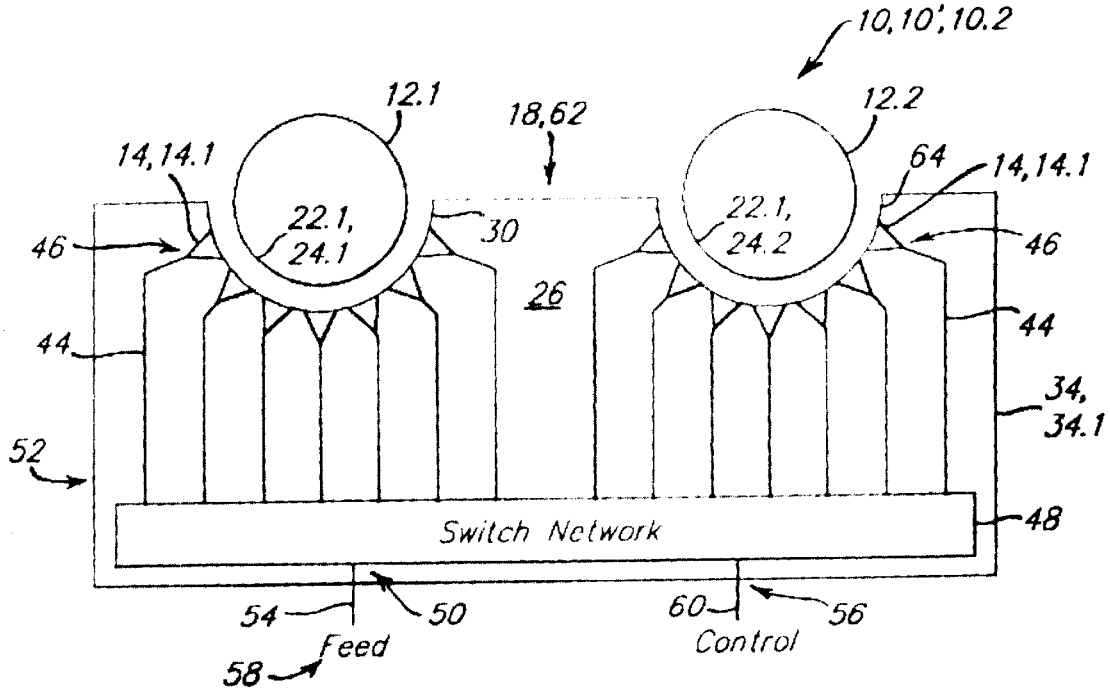
FIG. 7 illustrates a top view of a second embodiment of a multi-beam antenna, comprising a plurality electromagnetic lenses located proximate to one edge of a dielectric substrate.
Figure 8:
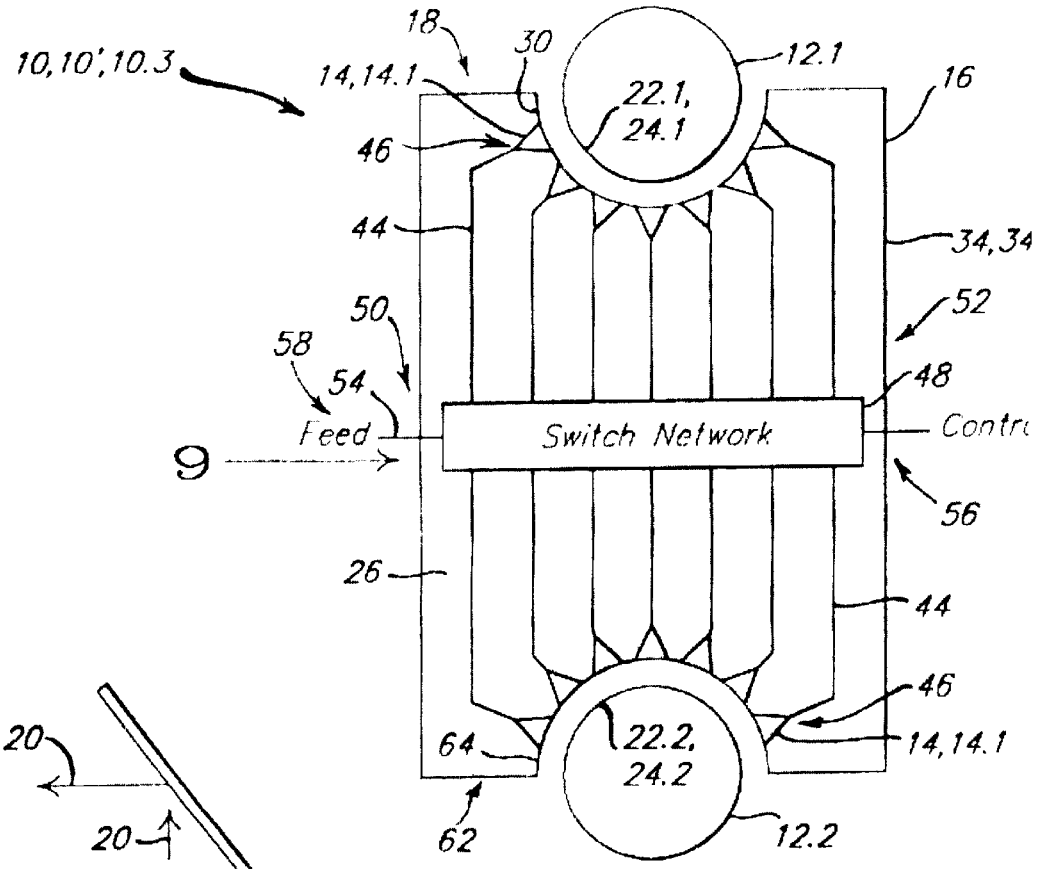
FIG. 8 illustrates a top view of a third embodiment of a multi-beam antenna, comprising a plurality electromagnetic lenses located proximate to opposite edges of a dielectric substrate.
Figure 9:
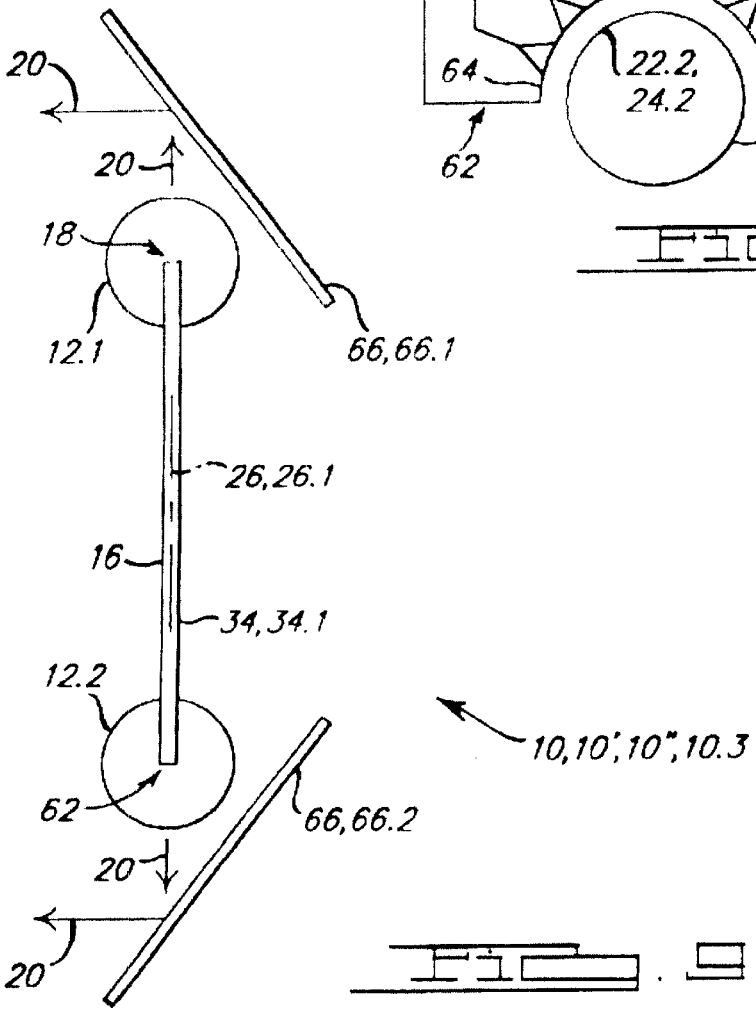
FIG. 9 illustrates a side view of the third embodiment illustrated in FIG. 8, further comprising a plurality of reflectors.

Referring to FIGS. 7, 8 and 9, in accordance with a second aspect, a multi-beam antenna 10' comprises at least a first 12.1 and a second 12.2 electromagnetic lens, each having a first side 22.1, 22.2 with a corresponding first contour 24.1, 24.2 at an intersection of the respective first side 22.1, 22.2 with the reference surface 26. The dielectric substrate 16 comprises at least a second edge 62 comprising a third contour 64, wherein the second contour 30 is proximate to the first contour 24.1 of the first electromagnetic lens 12.1 and the third contour 64 is proximate to the first contour 24.2 of the second electromagnetic lens 12.2.

Referring to FIG. 7, in accordance with a second embodiment of the multi-beam antenna 10.2, the second edge 62 is the same as the first edge 18 and the second 30 and third 64 contours are displaced from one another along the first edge 18 of the dielectric substrate 16.

Referring to FIG. 8, in accordance with a third embodiment of the multi-beam antenna 10.3, the second edge 62 is different from the first edge 18, and more particularly is opposite to the first edge 18 of the dielectric substrate 16.

Referring to FIG. 9, in accordance with a third aspect, a multi-beam antenna 10" comprises at least one reflector 66, wherein the reference surface 26 intersects the at least one reflector 66 and one of the at least one electromagnetic lens 12 is located between the dielectric substrate 16 and the reflector 66. The at least one reflector 66 is adapted to reflect electromagnetic energy propagated through the at least one electromagnetic lens 12 after being generated by at least one of the plurality of antenna feed elements 14. A third embodiment of the multi-beam antenna 10 comprises at least first 66.1 and second 66.2 reflectors wherein the first electromagnetic lens 12.1 is located between the dielectric substrate 16 and the first reflector 66.1, the second electromagnetic lens 12.2 is located between the dielectric substrate 16 and the second reflector 66.2, the first reflector 66.1 is adapted to reflect electromagnetic energy propagated through the first electromagnetic lens 12.1 after being generated by at least one of the plurality of antenna feed elements 14 on the second contour 30, and the second reflector 66.2 is adapted to reflect electromagnetic energy propagated through the second electromagnetic lens 12.2 after being generated by at least one of the plurality of antenna feed elements 14 on the third contour 64. For example, the first 66.1 and second 66.2 reflectors may be oriented to direct the beams of electromagnetic energy 20 from each side in a common nominal direction, as illustrated in FIG. 9. Referring to FIG. 9, the multi-beam antenna 10" as illustrated would provide for scanning in a direction normal to the plane of the illustration. If the dielectric substrate 16 were rotated by 90 degrees with respect to the reflectors 66.1, 66.2, about an axis connecting the respective electromagnetic lenses 12.1, 12.1, then the multi-beam antenna 10" would provide for scanning in a direction parallel to the plane of the illustration.

Figure 10:
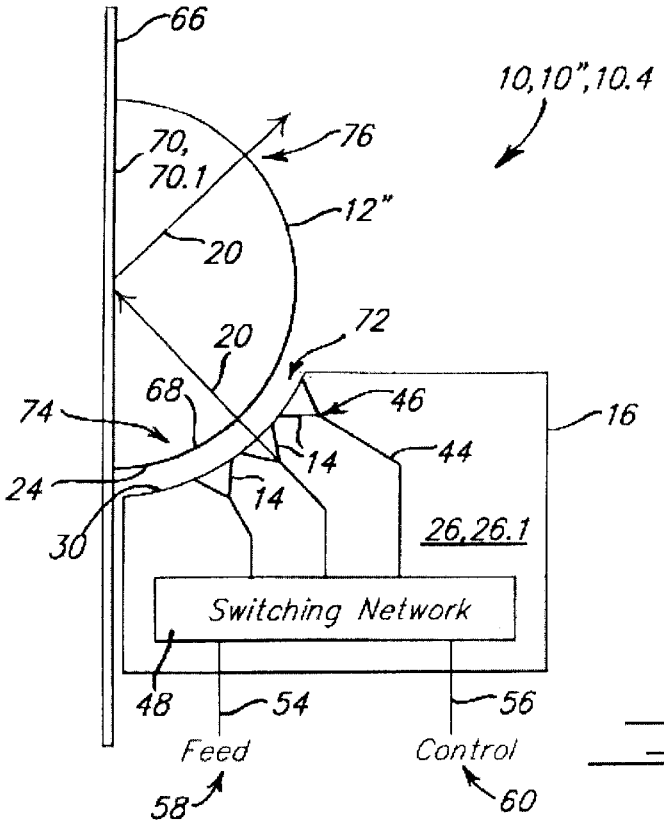
FIG. 10 illustrates a fourth embodiment of a multi-beam antenna, comprising an electromagnetic lens and a reflector.

Referring to FIG. 10, in accordance with the third aspect and a fourth embodiment, a multi-beam antenna 10", 10.4 comprises an at least partially spherical electromagnetic lens 12'", for example, a hemispherical electromagnetic lens, having a curved surface 68 and a boundary 70, for example a flat boundary 70.1. The multi-beam antenna 10", 10.4 further comprises a reflector 66 proximate to the boundary 70, and a plurality of antenna feed elements 14 on a dielectric substrate 16 proximate to a contoured edge 72 thereof, wherein each of the antenna feed elements 14 is adapted to radiate a respective plurality of beams of electromagnetic energy 20 into a first sector 74 of the electromagnetic lens 12'". The electromagnetic lens 12'" has a first contour 24 at an intersection of the first sector 74 with a reference surface 26, for example, a plane 26.1. The contoured edge 72 has a second contour 30 located on the reference surface 26 that is proximate to the first contour 24 of the first sector 74. The multi-beam antenna 10", 10.4 further comprises a switching network 48 and a plurality of transmission lines 44 operatively connected to the antenna feed elements 14 as described hereinabove for the other embodiments.

In operation, at least one feed signal 58 applied to a corporate antenna feed port 54 is either blocked, or switched to the associated feed port 46 of one or more antenna feed elements 14, via one or more associated transmission lines 44, by the switching network 48 responsive to a control signal 60 applied to a control port 56 of the switching network 48. Each antenna feed element 14 to which the feed signal 58 is applied launches an associated electromagnetic wave into the first sector 74 of the associated electromagnetic lens 12'". The electromagnetic wave propagates through—and is diffracted by—the curved surface 68, and is then reflected by the reflector 66 proximate to the boundary 70, whereafter the reflected electromagnetic wave propagates through the electromagnetic lens 12'" and exits—and is diffracted by—a second sector 76 as an associated beam of electromagnetic energy 20. With the reflector 66 substantially normal to the reference surface 26—as illustrated in FIG. 10—the different beams of electromagnetic energy 20 are directed by the associated antenna feed elements 14 in different directions that are nominally substantially parallel to the reference surface 26.

Figure 11:
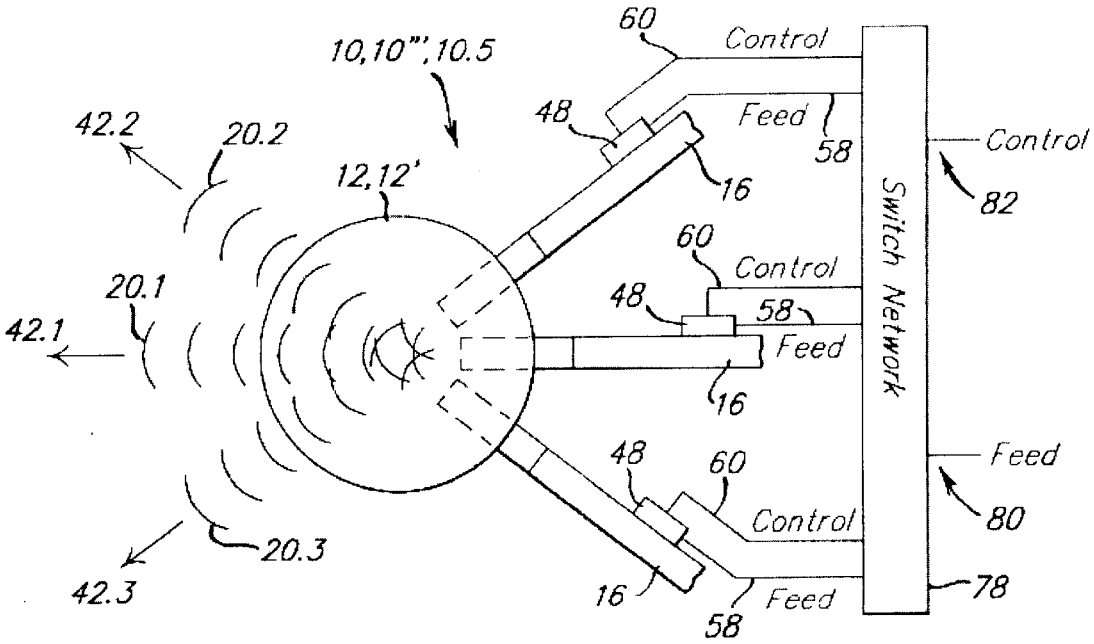
FIG. 11 illustrates a fifth embodiment of a multi-beam antenna.

Referring to FIG. 11, in accordance with a fourth aspect and a fifth embodiment, a multi-beam antenna 10'", 10.5 comprises an electromagnetic lens 12 and plurality of dielectric substrates 16, each comprising a set of antenna feed elements 14 and operating in accordance with the description hereinabove. Each set of antenna feed elements 14 generates (or is capable of generating) an associated set of beams of electromagnetic energy 20.1, 20.2 and 20.3, each having associated directions 42.1, 42.2 and 42.3, responsive to the associated feed 58 and control 60 signals. The associated feed 58 and control 60 signals are either directly applied to the associated switch network 48 of the respective sets of antenna feed elements 14, or are applied thereto through a second switch network 78 have associated feed 80 and control 82 ports, each comprising at least one associated signal. Accordingly, the multi-beam antenna 10'", 10.4 provides for transmitting or receiving one or more beams of electromagnetic energy over a three-dimensional space.

The multi-beam antenna 10 provides for a relatively wide field-of-view, and is suitable for a variety of applications, including but not limited to automotive radar, point-to-point communications systems and point-to-multi-point communication systems, over a wide range of frequencies for which the antenna feed elements 14 may be designed to radiate, for example, 1 to 200 GHz. Moreover, the multi-beam antenna 10 may be configured for either mono-static or bi-static operation.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

We claim:

1. A multi-beam antenna, comprising, a. at least one electromagnetic lens, wherein said at least one electromagnetic lens has a first side comprising a first contour at an intersection with a reference surface;

b. a dielectric substrate, wherein said dielectric substrate comprises a first edge comprising a second contour proximate to said first contour, said first edge of said dielectric substrate is located on said reference surface, and said first edge is proximate to said first side of one of said at least one electromagnetic lens; and c. a plurality of antenna feed elements on said dielectric substrate along said second contour of said first edge.

2. A multi-beam antenna as recited in claim 1, wherein said reference surface is a plane.

3. A multi-beam antenna as recited in claim 2, wherein said plane is substantially close to a center of said electromagnetic lens for said electromagnetic lens having a center.

4. A multi-beam antenna as recited in claim 1, wherein said at least one electromagnetic lens is selected from a spherical lens, a Luneburg lens, a spherical shell lens, a hemispherical lens, an at least partially spherical lens, an at least partially spherical shell lens, a cylindrical lens, and a rotational lens.

5. A multi-beam antenna as recited in claim 1, wherein said dielectric substrate comprises a dielectric of a printed circuit board.

6. A multi-beam antenna as recited in claim 1, wherein each said antenna feed element comprises a least one conductor operatively connected to said dielectric substrate.

7. A multi-beam antenna as recited in claim 1, wherein at least one said antenna feed element comprises an end-fire antenna element adapted to launch electromagnetic waves in a direction substantially towards said first side of said at least one electromagnetic lens, and said direction for at least one said end-fire antenna element is different from said direction for at least another said end-fire antenna element.

8. A multi-beam antenna as recited in claim 7, wherein said end-fire antenna is selected from a Yagi-Uda antenna, a coplanar horn antenna, a Vivaldi antenna, a tapered dielectric rod, a slot antenna, a dipole antenna, and a helical antenna.

9. A multi-beam antenna as recited in claim 1, further comprising at least one transmission line on said dielectric substrate, wherein at least one said at least one transmission line is operatively connected to a feed port of one of said plurality of antenna feed elements.

10. A multi-beam antenna as recited in claim 9, wherein said transmission line is selected from a stripline, a microstrip line, an inverted microstrip line, a slotline, an image line, an insulated image line, a tapped image line, a coplanar stripline, and a coplanar waveguide line.

11. A multi-beam antenna as recited in claim 9, further comprising a switching network having an input and a plurality of outputs, said input is operatively connected to a corporate antenna feed port, and each output of said plurality of outputs is connected to a different antenna feed element of said plurality of antenna feed elements via said at least one transmission line.

12. A multi-beam antenna as recited in claim 1, further comprising a switching network having an input and a plurality of outputs, said input is operatively connected to a corporate antenna feed port, and each output of said plurality of outputs is connected to a different antenna feed element of said plurality of antenna feed elements.

13. A multi-beam antenna as recited in claim 12, wherein said switching network is operatively connected to said dielectric substrate.

14. A multi-beam antenna as recited in claim 1, wherein said at least one electromagnetic lens comprises at least a first and a second electromagnetic lens, each of said first and second electromagnetic lenses has a first side, each said first side has a corresponding first contour at an intersection of said first side with said reference surface, said dielectric substrate comprises at least a second edge, said second edge comprises a third contour, said second contour is proximate to said first contour of said first electromagnetic lens, said third contour is proximate to said first contour of said second electromagnetic lens, further comprising at least one antenna feed element on said dielectric substrate along said third contour of said second edge.

15. A multi-beam antenna as recited in claim 14, wherein said second edge is the same as said first edge and said second and third contours are displaced from one another along said first edge.

16. A multi-beam antenna as recited in claim 14, wherein said second edge is different from said first edge.

17. A multi-beam antenna as recited in claim 14, wherein said second edge is opposite to said first edge.

18. A multi-beam antenna as recited in claim 17, further comprising at least first and second reflectors wherein said reference surface intersects said at least first and second reflectors, said first electromagnetic lens is located between said dielectric substrate and said first reflector, said second electromagnetic lens is located between said dielectric substrate and said second reflector, said first reflector is adapted to reflect electromagnetic energy propagated through said first electromagnetic lens after being generated by at least one of said plurality of antenna feed elements on said second contour, and said second reflector is adapted to reflect electromagnetic energy propagated through said second electromagnetic lens after being generated by at least one of said plurality of antenna feed elements on said third contour.

19. A multi-beam antenna as recited in claim 1, further comprising at least one reflector, wherein said reference surface intersects said at least one reflector, one of said at least one electromagnetic lens is located between said dielectric substrate and said reflector, and said at least one reflector is adapted to reflect electromagnetic energy propagated through said at least one electromagnetic lens after being generated by at least one of said plurality of antenna feed elements.

* * * * *

UNITED STATES PATENT AND TRADEMARK OFFICE

CERTIFICATE OF CORRECTION

PATENT NO. : 6,424,319 B2
DATED : July 23, 2002
INVENTOR(S) : James P. Ebling and Gabriel Rebeiz It is certified that error appears in the above-identified patent and that said Letters Patent is hereby corrected as shown below:

Column 4,
Line 6, delete "is"

Signed and Sealed this

Fourth Day of March, 2003

JAMES E. ROGAN
*Director of the United States Patent and Trademark Office*